US010383431B2

(12) United States Patent
Hancock

(10) Patent No.: US 10,383,431 B2
(45) Date of Patent: Aug. 20, 2019

(54) APPARATUS FOR DRINKING TWO BEVERAGES SIMULTANEOUSLY

(71) Applicant: Jacob Hancock, Enon, OH (US)

(72) Inventor: Jacob Hancock, Enon, OH (US)

( * ) Notice: Subject to any disclaimer, the term of this patent is extended or adjusted under 35 U.S.C. 154(b) by 0 days.

(21) Appl. No.: 16/037,712

(22) Filed: Jul. 17, 2018

(65) Prior Publication Data

US 2019/0014894 A1 Jan. 17, 2019

Related U.S. Application Data

(60) Provisional application No. 62/533,283, filed on Jul. 17, 2017.

(51) Int. Cl.

| | |
|---|---|
| ***A45F 5/10*** | (2006.01) |
| ***B65D 23/10*** | (2006.01) |
| *A47G 23/02* | (2006.01) |

(52) U.S. Cl.

CPC ..... *A45F 5/10* (2013.01); *B65D 23/106* (2013.01); *A45F 2005/1013* (2013.01); *A45F 2200/0583* (2013.01); *A47G 23/0241* (2013.01)

(58) Field of Classification Search

CPC ..... A45F 5/10; A45F 2005/1006; A45F 2005/1013; A45F 2200/0583; A47G 23/0208; A47G 23/0241; B65D 23/104; B65D 23/106

USPC ..... 294/27.1, 31.2, 32, 87.2, 143, 159, 160, 294/162, 168, 169

See application file for complete search history.

(56) References Cited

U.S. PATENT DOCUMENTS

| | | | | | |
|---|---|---|---|---|---|
| 1,888,324 | A | * | 11/1932 | Matthai | A47F 7/285 211/74 |
| 2,654,628 | A | * | 10/1953 | Klante | A47G 23/0208 248/145.6 |
| 2,676,836 | A | * | 4/1954 | Raphael | B65D 71/50 294/159 |
| 2,690,283 | A | * | 9/1954 | Comploier | B65D 71/0003 206/167 |
| 2,865,669 | A | * | 12/1958 | Linthicum | B65D 71/50 294/87.2 |
| 3,951,259 | A | * | 4/1976 | Oglesbee | B65D 71/50 206/164 |
| 4,494,788 | A | * | 1/1985 | Altemose | A45F 5/10 294/159 |
| 4,623,185 | A | * | 11/1986 | Thomas | B65D 71/50 206/158 |
| 4,735,313 | A | * | 4/1988 | Schoenberg | B65D 71/0003 206/427 |

(Continued)

*Primary Examiner* — Dean J Kramer
(74) *Attorney, Agent, or Firm* — Bradley Marzola

(57) ABSTRACT

Exemplary embodiments of the present invention are directed to an apparatus for drinking multiple beverages simultaneously. The apparatus may be held by a single hand allowing the user the opportunity to text or play games with the other. The apparatus may comprise securing straps to substantially keep the beverage containers in place as the beverages are tilted toward the user's mouth. The components of the apparatus may be adjustable to allow for beverage containers of all shapes and sizes. The apparatus may stand on its own without spilling the beverages when not in use. The beverage containers may rest on an angled bracket to position the beverage spouts in close proximity to each other.

18 Claims, 6 Drawing Sheets

(56) References Cited

U.S. PATENT DOCUMENTS

| | | | | | |
|---|---|---|---|---|---|
| 4,889,245 | A * | 12/1989 | Rinke | B65D 71/50 | 211/49.1 |
| 5,335,954 | A * | 8/1994 | Holub | A45F 5/10 | 215/376 |
| 5,707,096 | A * | 1/1998 | Gregory | B65D 71/50 | 294/163 |
| 8,870,027 | B2 * | 10/2014 | Kraenzle | B65D 1/04 | 215/6 |

* cited by examiner

APPARATUS FOR DRINKING TWO BEVERAGES SIMULTANEOUSLY

CROSS-REFERENCE TO RELATED APPLICATION

This application is a nonprovisional application and claims priority to U.S. Provisional Patent Application No. 62/533,283 filed Jul. 17, 2017, the contents of which are incorporated by reference as if fully recited herein.

TECHNICAL FIELD

Exemplary embodiments of the present invention relate generally to an apparatus for consuming multiple beverages simultaneously.

BACKGROUND

Presently, there are a number of devices for improving the experience of drinking a bottled or canned beverage. Koozies exist to keep a beverage cold by preventing heat from the user's hand to come in contact with the beverage container. Attachable handles exist for the same reason and to make holding the bottle or can more ergonomic. Other devices, Koozies included, enhance the appearance of the bottle or can as your favorite sports team or other picture, logo, or saying may encompass the drinking device. Yet, each of these devices is only suited for a single can or bottle. If a user wants to drink from two separate devices, he or she would have to find a cup to mix the two together. That user could also use each hand to hold a separate beverage and pour both into his or her mouth at the same time. Neither is ideal or meets the needs of the industry. What is needed in the art is an apparatus that allows a person to drink from two separate containers while still having a free hand available. Exemplary embodiments of the present invention seek to solve this problem.

SUMMARY OF THE INVENTION

An exemplary embodiment of the present invention is directed to a drinking apparatus capable of holding two separate beverages in a manner that allows the user to drink both simultaneously. The apparatus may comprise a frame, which may include a handle attached to an angled bracket. At the end of each angled bracket leg may be an adjustable base support. The base supports may raise and lower along each of the two legs of the angled bracket. The entire apparatus may have the appearance of a tri-pod wherein the bracket comprises two legs and the handle is a third leg. The entire apparatus may rest on these three legs, retaining the beverages in an upright position such that the user can set the inventive device down without risk of spilling the beverages. The apparatus may also comprise a securing mechanism to keep the beverages in the proper orientation and location for efficient drinking. An example of this securing mechanism may be adjustable straps that allow the user to secure variously shaped containers. Another example of this securing mechanism may also be a rigid enclosure that it allows a beverage container to slide in and out but prevents rotating or lateral movements. A rigid enclosure may comprise an insulating material to keep the beverages cold. A rigid enclosure may have a perimeter slightly larger than the intended beverage containers perimeter.

An angled bracket may take a variety of different angles based upon the type of beverage containers placed on each bracket leg, how high they are adjusted along the leg, and how far apart the two legs are from each other. Exemplary embodiments of the invention may provide flexibility to the types of containers that may be attached to the apparatus and still allow the user to line up the drinking end of the beverage container close enough that each may pour into the users mouth at the same time. The inventive apparatus may also comprise a bottle opener attachment to further convenience the user and eliminate the need for extra devices. The entire apparatus may be carried with a single hand, affording the user the opportunity to text, play yard or card games, or various other activities that previously required setting down at least one of the two beverages to accomplish.

Exemplary embodiments of the present invention will now be described more fully hereinafter with reference to the accompanying drawings, which are intended to be read in conjunction with both this summary, the detailed description and any preferred and/or particular embodiments and variations specifically discussed or otherwise disclosed. This invention may, however, be embodied in many different forms and should not be construed as limited to the embodiments set forth herein; rather, these embodiments are provided by way of illustration only and so that this disclosure will be thorough, complete and fully conveys the full scope of the invention to those of ordinary skill in the art.

DETAILED DESCRIPTION OF THE INVENTION

Figure 1:
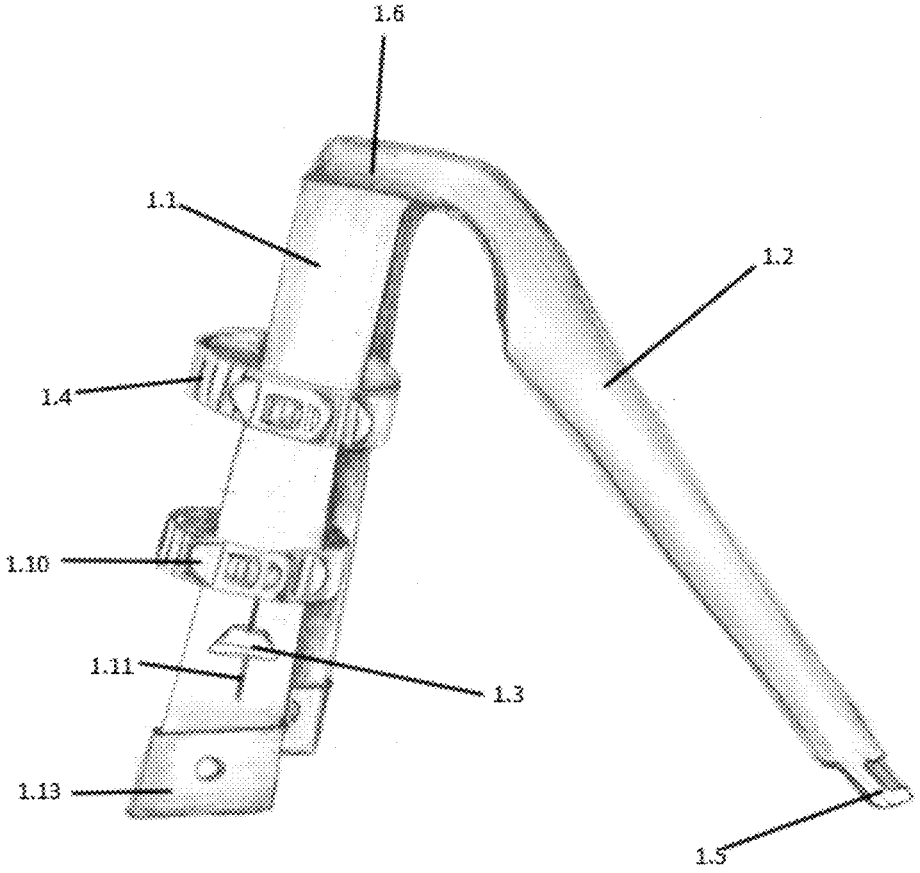
FIG. 1 is a side view of a first embodiment of the invention.
Figure 2:
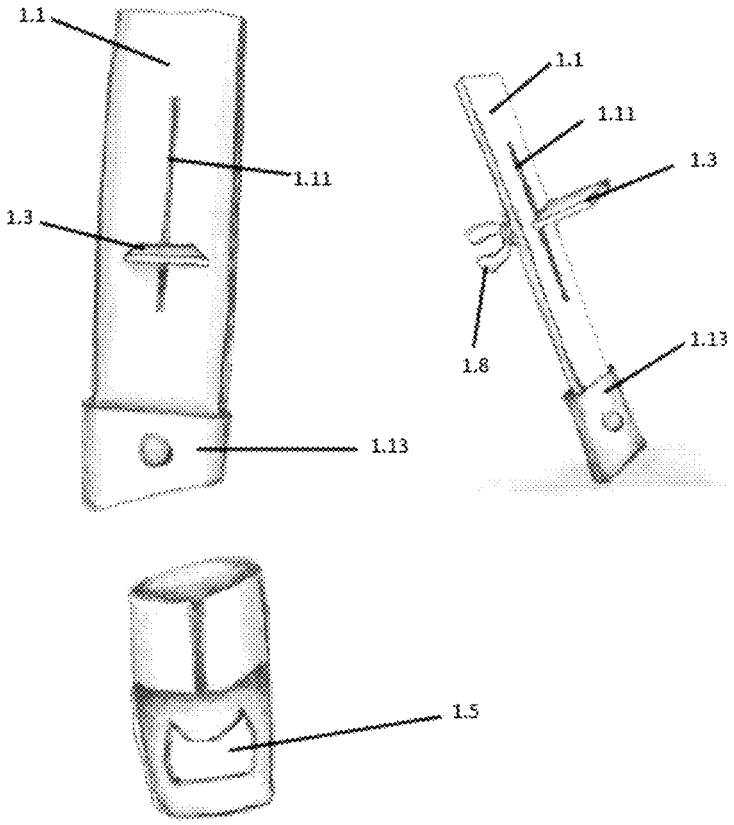
FIG. 2 is a view of individual apparatus components.
Figure 3:
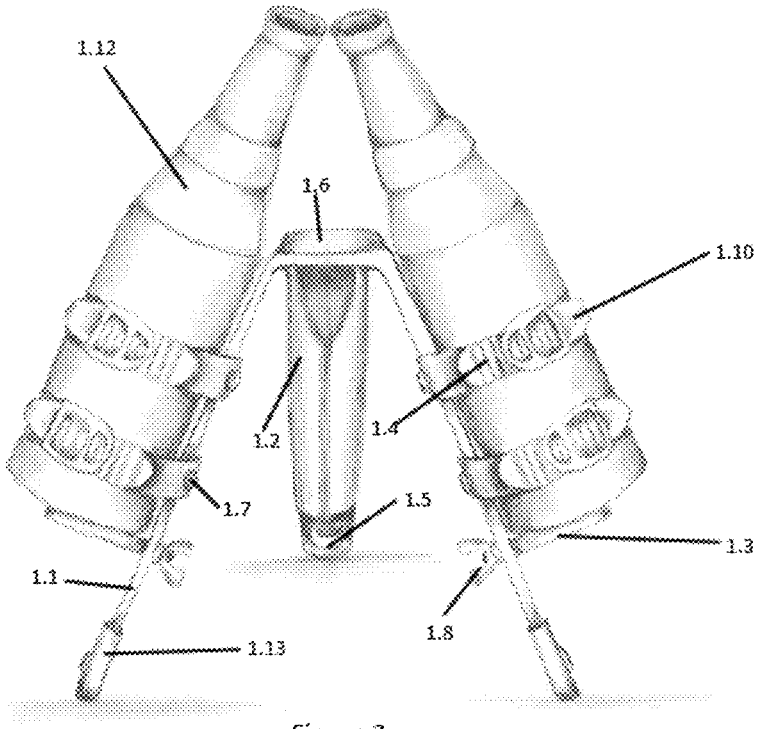
FIG. 3 is a front view of a first embodiment with bottles strapped onto the device.

Referring to FIGS. 1-3, an exemplary embodiment of the invention is depicted. An angled support bracket 1.1 and handle 1.2 may form a tripod apparatus. Located at the end of the handle 1.2 may be a bottle opener 1.5. This bottle opener 1.5 may be continuous with the handle 1.2 such that it forms a single piece. Alternatively, the bottle opener 1.5 may be a separate attachment that slides over the end of the handle. The angled bracket 1.1 may form two of the three legs of the tripod. Along each leg may be a vertical slot 1.11. The vertical slot 1.11 allows for vertical movement of a bottom support 1.3 and associated fastener 1.8. The bottom support 1.3 may comprise a threaded arm that traverses through the vertical slot 1.11. This would allow a wing nut or other fastener 1.8 to easily loosen and tighten to a proper height depending on the beverage container 1.12. One of ordinary skill in the art will recognize many possible adjustable and locking mechanisms and the use of a wing nut fastener is merely meant to be an example and not intended to limit the application in any way beyond the scope of the claims.

Each angled bracket 1.1 leg may also comprise at least one strap or other securing device 1.4 to lock the beverage container 1.12 in place. The strap 1.4 may have a mechanism to allow adjustment of the strap to account for varying sizes of beverage containers such as a tightening mechanism with release button or snap 1.10. The straps 1.4 may also be made of an elastic material or a hook and loop connecter system to meet the same end. Additionally, magnets may be used to connect various components to a metal frame. For example, magnets may be attached to the straps such that the straps may be placed anywhere along the metal legs. Preferably, the securing device 1.4 is made of an insulating material to prevent heat from being transferred to or away from the beverage. The securing device 1.4 may be attached to the bracket leg by a rivet 1.7 or other attachment means. The embodiment of FIGS. 1-3 may have the below dimensions. All dimensions are provided as examples and are not intended to limit the application beyond the scope of the claims. One example of the angled support bracket 1.1 may be a 16"×1"×⅛" flat bar that is angled at about 112.5 degrees with a 1.5" flat section 1.6, which allows for mounting to a handle 1.2. The handle 1.2 may begin with a bottle opener 1.5 and end with about a 45-degree bend flat section to mount to the angled bracket flat section 1.6. Alternatively, the bottle opener may be placed below the flat section 1.6. The handle 1.2 and bracket 1.1 may be welded together or manufactured as a single piece. One of ordinary skill in the art will recognize many ways to connect the handle 1.2 and bracket 1.1 together. The vertical slot may be ¼" wide and located below the securing device 1.4 along the legs.

As depicted in FIG. 3, the device and attached beverage containers may stand on its own as a tripod without spilling the beverages. For added stability, a rubber coating 1.13 or attachment may be added to the legs of the bracket 1.1 or the end of the handle 1.2. The entire apparatus may be made of any material with the required rigidity and strength to support the holding of two beverage containers and its contents. Although the device as described above performs best with adjustable components, a single embodiment may be specifically made for a specific beverage container and still function to allow the user to drink two beverages at once with a single hand.

In other embodiments, each leg or handle may be attached to the bracket flat section 1.6 or platform by a hinge. This may allow for a change in angles to properly meet the necessary adjustments for the given beverage container. The hinges may also allow for the ability to fold the device into a more compact manner, allowing for easier transportation or storage. The hinges may have sufficient friction such that the forces from moving the entire device with two full bottles would not cause movement in the hinge but extra force applied by the user will. Alternatively, each leg or handle may have a separate locking mechanism for any rotational movement about the flat section 1.6 of the bracket.

Figure 4:
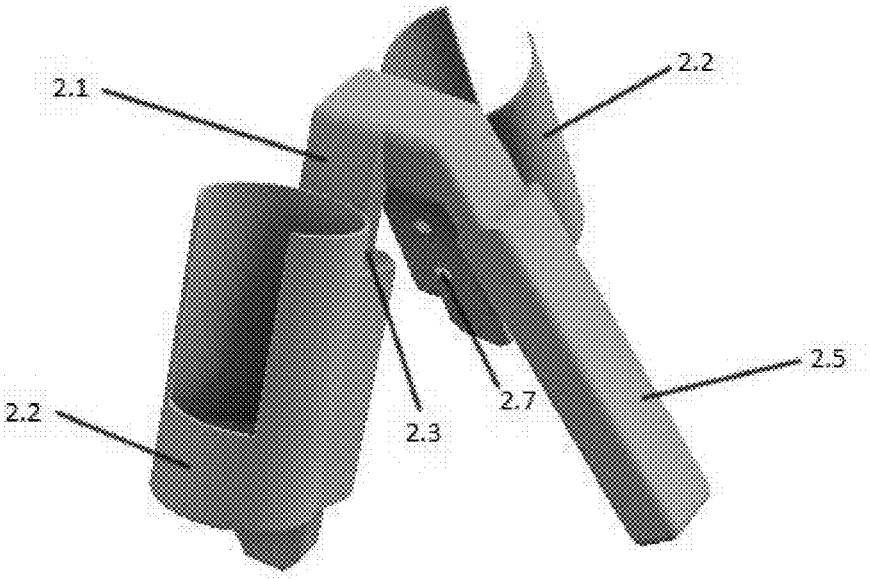
FIG. 4 is a perspective view of a second embodiment of the invention.
Figure 5:
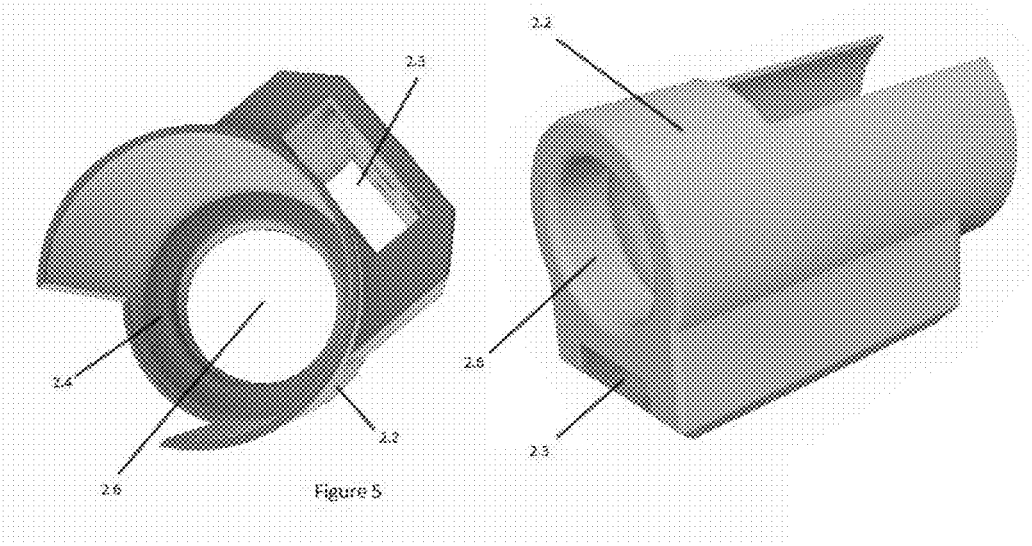
FIG. 5 is individual views of a beverage container holder.
Figure 6:
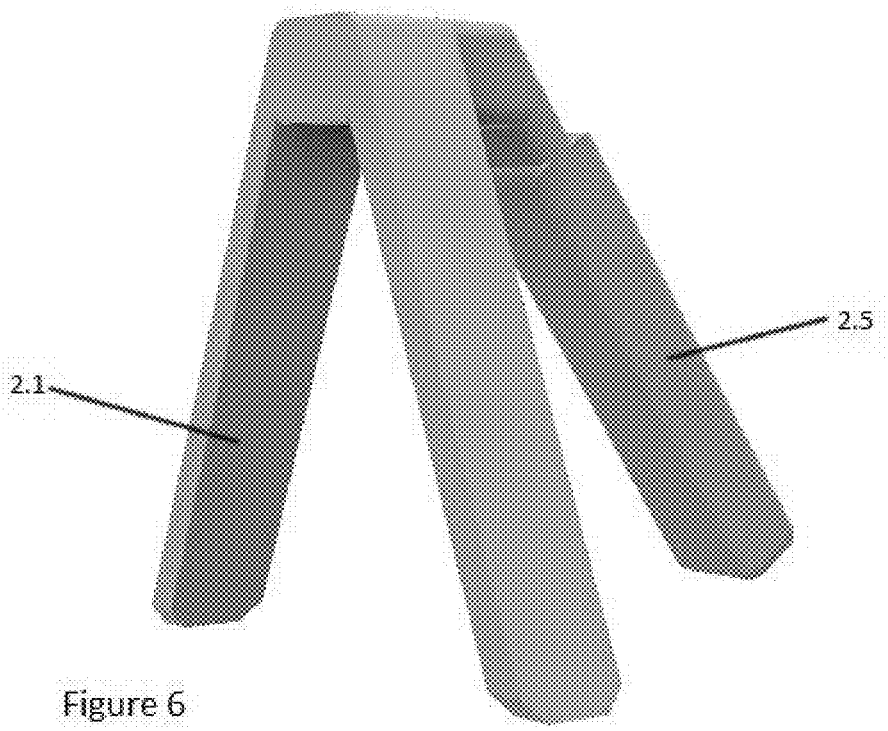
FIG. 6 is an individual view of a bracket and handle manufactured as a single piece.

Referring to FIGS. 4-6, a second embodiment is depicted. This embodiment is manufactured as a single piece and may be created by additive manufacturing, molding, or any other sufficient manufacturing means. The frame comprises a handle portion 2.5 and a bracket portion with two legs 2.1. The handle 2.5 may be slightly shorter than the legs to facilitate a slight backwards angle that prevents the beverages from falling forward when the device is resting on a surface. A metal frame may employ a thinner frame, yet, a 3D-printed or injection molded plastic frame may require a thicker frame to enhance rigidity and ensure the device is strong enough to support two full beverage containers. In this embodiment, the beverage container holders 2.2 may contain a slot 2.3 behind the beverage holding enclosure such that the legs may slide through the slot 2.3. A fastener 2.7 or other device may be used to lock the beverage container holders 2.2 in place once set to the proper height. For example, a screw or knob may be twisted in the back side of the slot 2.7 such that the end of a screw is pressed against the leg of the frame 2.1. This may increase the friction and prevent the beverages from moving once placed in the apparatus. One of ordinary skill in the art will recognize many plastic lock and release mechanisms may be utilized to meet the same end without detracting from the scope and spirit of this invention. The beverage container holders 2.2 may contain an opening 2.6 at the bottom such that condensation does not build up. In such an embodiment, the bottom of the beverage container holder 2.2 may comprise a ledge 2.4 for the beverage container to rest upon. In other embodiments, the beverage container holders 2.2 may contain an additional beverage holding piece that slides over the mouth of the bottle and connects with the beverage container holder 2.2. This may prevent the bottles from falling toward the user as the person tilts the bottles to take a sip. This additional beverage holding piece may also be attached to the beverage container holder 2.2 by a hinge that rotates into contact with the beverage container holder 2.2 after the beverage container has been placed in the device. As this embodiment has a rigid enclosure for holding the bottle container, the embodiments may need to be manufactured as different sizes for different sized containers. For example, most 12 oz bottles are of similar shape and size to allow for a single height adjustment and circumference of beverage container holder 2.2. However, the beverage container holders 2.2 may be made bigger such that the device can hold two 40 oz bottles of beer or 20 oz bottles of soda, or the beverage container holders may be square or such other shape to conform to the size of the beverage container. Some embodiments may allow for different sizes of beverage container holders 2.2 on each leg such that one side may hold a bottle of liquor, while the other side holds a mixer. Additionally, the inventive device may be made with multiple set height adjustments, such as two or three, to account for most beverage containers instead of making a single sliding holder to accommodate all beverage containers. One of ordinary skill in the art will recognize that various components of the first embodiment may apply to the second embodiment in the same or similar fashion. For example, the second embodiment may be modified with elastic or adjustable straps to further increase flexibility in use.

Other embodiments of the device may not operate as a tripod. For example, each leg of the angled bracket may end of sufficient width or of a sufficient base area such that the device is stable on only two legs. In such an embodiment, the handle may be smaller such that it never touches the resting surface or the handle may be non-existent wherein the user simply holds one of the beverage containers to drink from both containers simultaneously.

Although two bottles are depicted and described above, the device may be modified with additional legs to support the use of three or more beverages. Additionally, bottles are not the only beverage containers that may be used by this invention. For example, cans may be adapted to look and function like a bottle with an extended neck and spout or straws may be utilized to bring the drinking spout of any container to a single point for the user. An additional attachment may be utilized by the user to further funnel two or more bottle openings to a single point for drinking. This attachment may be made of silicone or another flexible material to press onto the desired bottles such that when the beverage is tipped toward the users mouth the beverage comes out of a single spout. In some embodiments, the sides of the spout attachment may contain partial blockings to allow the user to customize the drinking portions of the beverages. For example, the inventive device with one side being whiskey and the other being cola may have half of the whiskey spout blocked such that twice as much cola is poured into the user's mouth for the desired mixed drink.

Additional modifications may be made to the apparatus for improved convenience. For example, the apparatus may comprise a punch hole such that a carabiner may be used to secure the apparatus to a backpack while on a camping trip. Other tools may be attached such as a compass, stopwatch, pocket knife, corkscrew, or wrist strap without hindering the user's ability to drink multiple beverages with the invention. In certain embodiments, the bottle holding component may be made of a freezable material such that the entire device may be placed in the freezer before use to keep the beverages cold. Additionally, insulated material may be used to keep the handle, especially a metal handle, warm during a winter tailgate or cool during a mid-summer pool party. The apparatus may also be modified to include a battery or solar powered cooler for the beverage containers or heater for the handle.

Any embodiment of the present invention may include any of the optional or exemplary features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An apparatus for holding two beverage containers comprising:

a first leg, a second leg, and a third leg connected to a platform;

said first leg being a handle; and said second and third legs being substantially similar to each other and further comprising:

a base platform adapted to move and lock vertically at least along a portion of the second or third leg; and at least one securing device adapted to retain a beverage container in substantially the same position relative to the apparatus as the apparatus is tilted.

2. The apparatus of claim 1 wherein said base platforms are substantially perpendicular to the respective second or third legs.

3. The apparatus of claim 2 wherein:

said second leg and third legs each comprise a vertical slot; and wherein said base platforms are each connected to an adjustable fastener that traverses from a first side of the second or third leg to an opposite side of the second or third leg through the vertical slot.

4. The apparatus of claim 3 wherein said securing device is a strap connected to said second or third leg above the vertical slot.

5. The apparatus of claim 1 wherein said securing device is made of an insulated material.

6. The apparatus of claim 1 wherein said securing device is a strap connected to said second or third leg by a rivet.

7. The apparatus of claim 1 further comprising a bottle opener.

8. An apparatus for holding multiple beverage containers comprising:

an angled bracket wherein said angled bracket comprises at least two beverage supporting legs; and at least two separately formed beverage holders;

wherein said beverage holders comprise:

a hollow slot allowing for movement of the beverage holders along said at least two beverage supporting legs; and a locking mechanism that prevents movement of the beverage holders along said at least two beverage supporting legs.

9. The apparatus of claim 8 wherein said supporting legs having a sufficient base to stand freely and support a full beverage container for each leg.

10. The apparatus of claim 8 wherein said beverage holders comprise:

a wall of perimeter slightly greater than an intended beverage container perimeter; and a base plate.

11. The apparatus of claim 10 wherein said base plate comprises a supportive ledge surrounding a cavity.

12. The apparatus of claim 8 further comprising a handle.

13. The apparatus of claim 12 wherein said handle is a shorter length than said at least beverage supporting legs such that said handle does not contact a resting surface when said apparatus is freely supported by the at least two beverage supporting legs.

14. The apparatus of claim 8 wherein said at least two beverage supporting legs further comprise a plurality of lock heights such that said locking mechanism may engage said lock heights to suspend the beverage holders at the lock height.

15. An apparatus for holding multiple containers comprising:

a first, a second, and a third leg, wherein each leg has a top end and a bottom end, and wherein the top ends of each leg are connected;

a base platform for each of at least two of the three legs;

at least one securing device adapted to retain at least one beverage container in substantially the same position relative to the apparatus as the apparatus is tilted;

wherein said legs with the base platforms are angled such that when the at least one beverage containers are secured to the apparatus, a spout of each at least one beverage container is directed in close proximity to the other spout; and wherein a bottom surface of said at least one beverage container rests at least partially in contact with the respective base platform when the apparatus is not tilted.

16. The apparatus of claim 15 wherein exactly two of the three legs comprise the base platform and wherein the one leg without the base platform comprises an insulated sheath or is made from an insulated material.

17. The apparatus of claim 15 wherein said base platform is adapted to move and lock vertically at least along a portion of the leg.

18. The apparatus of claim 17 wherein said legs with the base platforms further comprise a plurality of lock heights such that a locking mechanism may engage said lock heights to suspend the base platforms at the lock height.

* * * * *